US009869207B2

(12) United States Patent
Iseki et al.

(10) Patent No.: US 9,869,207 B2
(45) Date of Patent: Jan. 16, 2018

(54) MEMBER ASSEMBLING APPARATUS OF ROTARY MACHINE

(71) Applicant: Mitsubishi Heavy Industries, Ltd., Tokyo (JP)

(72) Inventors: Keisuke Iseki, Tokyo (JP); Kenichi Arase, Tokyo (JP); Kunihiko Waki, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 841 days.

(21) Appl. No.: 13/659,017

(22) Filed: Oct. 24, 2012

(65) Prior Publication Data

US 2013/0139368 A1 Jun. 6, 2013

(30) Foreign Application Priority Data

Oct. 27, 2011 (JP) ..... 2011-236026

(51) Int. Cl.
*B25B 27/14* (2006.01)
*F01D 25/28* (2006.01)
(Continued)

(52) U.S. Cl.
CPC ..... *F01D 25/285* (2013.01); *F23R 3/60* (2013.01); *F01D 9/023* (2013.01);
(Continued)

(58) Field of Classification Search
CPC ..... F01D 25/285; F01D 9/023; F23R 3/60; F23R 2900/00017; Y10T 29/53974;
(Continued)

(56) References Cited

U.S. PATENT DOCUMENTS 4,681,305 A * 7/1987 Green ..... B23D 57/0092 269/139
5,911,680 A 6/1999 Takeoka
5,921,075 A 7/1999 Shimoyama et al.

FOREIGN PATENT DOCUMENTS

CN 1159380 9/1997
EP 0 800 892 10/1997
(Continued)

OTHER PUBLICATIONS

Machine Translation of WO2011/033697 by Shiotani et al.*
(Continued)

*Primary Examiner* — Monica Carter
*Assistant Examiner* — Nirvana Deonauth
(74) *Attorney, Agent, or Firm* — Wenderoth, Lind & Ponack, L.L.P.

(57) ABSTRACT

A transition piece assembling apparatus according to the disclosure includes a pair of rails which is provided to be in the direction parallel with an axis of a combustor transition piece, and to be spaced at intervals and in a plane perpendicular to the axis of a combustor transition piece, support portions which are connected to the combustor transition piece and support the member to be movable in longitudinal directions of the rails, a trapezoidal screw which is disposed in parallel with the axis of the combustor transition piece between the pair of rails, a female screw block which is threaded onto the trapezoidal screw, and a sliding member which is provided between the female screw block and the combustor transition piece and connects the female screw block and the combustor transition piece to be movable relative to each other in a plane perpendicular to a female screw axis.

20 Claims, 15 Drawing Sheets

(51) Int. Cl.
*F23R 3/60* (2006.01)
*F01D 9/02* (2006.01)

(52) U.S. Cl.
CPC ..... *F05D 2230/68* (2013.01); *F23R 2900/00017* (2013.01); *Y10T 29/53974* (2015.01)

(58) Field of Classification Search
CPC ..... Y10T 403/7111; Y10T 403/7182; Y10T 403/7188; Y10T 403/7094; Y10T 403/3926; Y10T 403/3981; Y10T 403/4605; F05D 2230/68
USPC ..... 29/281.1; 269/166–171.5, 143, 249
See application file for complete search history.

(56) References Cited

FOREIGN PATENT DOCUMENTS

| | | |
|---|---|---|
| EP | 2 051 009 | 4/2009 |
| JP | 08-210642 | 8/1996 |
| JP | 9-210361 | 8/1997 |
| JP | 10-196959 | 7/1998 |
| JP | 10-231737 | 9/1998 |
| JP | 2009-115782 | 5/2009 |
| JP | 2009-243310 | 10/2009 |
| JP | 2011-064112 | 3/2011 |
| JP | 2011-64112 | 3/2011 |
| WO | 2011/033697 | 3/2011 |

OTHER PUBLICATIONS

International Search Report dated Jan. 15, 2013 in International (PCT) Application No. PCT/JP2012/077601.
Written Opinion of the International Searching Authority dated Jan. 15, 2013 in International (PCT) Application No. PCT/JP2012/077601.
Extended European Search Report dated May 4, 2015 in corresponding European Patent Application No. 12844164.9.
Chinese Office Action dated May 6, 2015 in corresponding Chinese Patent Application No. 201280037564.1 with partial English translation.

* cited by examiner

MEMBER ASSEMBLING APPARATUS OF ROTARY MACHINE

TECHNICAL FIELD

The present invention relates to a member assembling apparatus of a rotary machine for attaching and detaching a member such as a combustor transition piece within a casing in a rotary machine such as a gas turbine.

This application claims priority based on Japanese Patent Application, First Publication No. 2011-236026, filed on Oct. 27, 2011 in the Japanese Patent Office, the content of which is incorporated herein by reference.

BACKGROUND ART

As shown in FIGS. 1 and 2, a gas turbine 200 generally includes a compressor 201 which produces compressed air, a plurality of combustors 1 of which each mixes a fuel with the compressed air produced by the compressor 201 and produces a combustion gas, and a turbine 202 which is driven by the combustion gas produced by the combustor 1. The combustor 1 includes a combustor inner cylinder 2 to which the compressed air and fuel are supplied to be burned, and a combustor transition piece 3 which introduces the combustion gas produced by the combustor inner cylinder 2 into a combustion gas passage 203 of the turbine 202. The combustors 1 are arranged in an annular shape so as to surround a turbine rotor, and each combustor 1 is connected to an inlet portion 203*a* of the combustion gas passage 203 within the turbine 202.

In each of the combustors 1, the combustor transition piece 3 is inserted into a casing 4 to be connected to the inlet portion 203*a* of the combustion gas passage 203, and the combustor inner cylinder 2 is connected to a base end of the combustor transition piece 3. As shown in FIGS. 2 and 3, an opening portion 4*a* of the casing 4 is blocked in such a manner that a cover body 7 is fixed to cover fixing bolt holes 4*b* which are cover fixing portions formed along an outer edge of the casing. As shown in FIG. 1, a plurality of pipes 8 is disposed around the plural combustors 1 arranged in an annular shape, wherein the pipes 8 include a fuel supply pipe to supply a fuel, a cooling air supply pipe to cool each combustor 1, etc.

The above-mentioned combustor 1 is assembled by the insertion of the combustor transition piece 3 and the combustor inner cylinder 2 into the casing 4 from the opening portion 4*a* in sequence after the compressor 201, the casing 4, and the turbine 202 are constructed. In addition, each member constituting the gas turbine 200 is worn out through the operation thereof, and is thus periodically inspected with an individual period of each member and replaced as necessary. In general, since the inspection period of the combustor 1 is short compared with the inspection periods of the turbine 202 and the compressor 201, there is an opportunity to detach and inspect the combustor 1. The combustor 1 itself has such a weight (for example, about 100 kg) that the combustor transition piece 3 or the combustor inner cylinder 2 cannot be independently lifted by a person, and it is difficult to gain a foothold because the combustor 1 is located above an installation surface 200*a* of the gas turbine 200 in the vicinity of the casing 4. For this reason, a variety of attaching and detaching jigs are proposed in order to inspect the combustor 1 (for example, see Patent Document 1).

Specifically, an attaching and detaching jig of a combustor transition piece is proposed in Patent Document 1. This attaching and detaching jig of the combustor transition piece includes a pair of guide portions which is provided within a casing and extends in the axial direction of a combustor, a pair of moving portions which is provided in the combustor transition piece and is movable along the guide portions, and an advancing and retracting mechanism which advances and retracts the combustor transition piece along the axial direction of the combustor by moving each moving portion along the guide portions.

The advancing and retracting mechanism includes a ball screw which is disposed along the guide portions and rotatably supported, and a nut member which is threaded onto the ball screw and fixed to the combustor transition piece. In such a configuration, the nut member moves along the ball screw as the ball screw rotates, such that the combustor transition piece advances and retracts along the axial direction of the combustor.

PRIOR ART DOCUMENT

Patent Document

[Patent Document 1] Japanese Patent Application, First Publication No. 2011-64112

SUMMARY OF THE INVENTION

Problem which the Invention is to Solve

However, according to the attaching and detaching jig of the combustor transition piece disclosed in Patent Document 1, when the combustor transition piece advances and retracts due to the rotation of the ball screw, there is a problem in that a load required for the rotation of the ball screw is increased.

In more detail, during the advancing and retracting of the combustor transition piece, there is a case of causing a deviation of a movement distance thereof along the guide portions between the pair of moving portions. In this case, the axial direction of the combustor transition piece is deviated from the axial direction of the combustor with the consequence that the combustor transition piece enters an inclined state with respect to the combustor. Then, a load is applied to the ball screw to result in a bending at the ball screw. If the bending is caused at the ball screw, when the nut member moves along the ball screw, resistance therebetween is increased, thereby the load required for the rotation of the ball screw is increased.

The present invention has been made in view of the above-mentioned problems, and an object thereof is to provide means that is able to prevent a load from being applied to a ball screw and to smoothly rotate the ball screw when a member advances and retracts by turning the ball screw in order to attach and detach the member constituting a rotary machine, even if the member is an inclined state.

Means for Solving the Problem

A member assembling apparatus of a rotary machine according to the present invention includes a pair of rails which is provided to be in the direction parallel with an axis of a member constituting a rotary machine, and to be spaced at intervals in a plane perpendicular to the axis of a member constituting a rotary machine, support portions which are connected to the member constituting the rotary machine and support the member to be movable in longitudinal directions of the rails, a screw shaft which is disposed in parallel with the axis of the member constituting the rotary machine between the pair of rails, a female screw block which is threaded onto the screw shaft, and a sliding member which is provided between the female screw block and the member and connects the female screw block and the member to be movable relative to each other in a plane perpendicular to a female screw axis.

In such a configuration, there is a case of causing a deviation of a movement distance along the rails between the support portions. However, the deviation is absorbed by the sliding member provided between the female screw block and the member. Accordingly, a load is not applied to the screw shaft and a bending is not caused at the screw shaft. Thus, the screw shaft may be smoothly rotated.

In the member assembling apparatus of a rotary machine according to the present invention, the sliding member may connect the female screw block and the member to be movable relative to each other in a direction parallel with a line segment linking the pair of rails in the plane perpendicular to the female screw axis.

In such a configuration, when the deviation of the movement distance along the rails is caused between the support portions, there is a case in which the member moves in the direction parallel with the line segment linking the pair of rails. However, even in this case, the movement of the member is absorbed by the sliding member. Therefore, a load is not applied to the screw shaft and a bending is not caused at the screw shaft. Thus, the screw shaft may be smoothly rotated.

In the member assembling apparatus of a rotary machine according to the present invention, a fitting groove may be provided at one of the female screw block and the sliding member, and a fitting piece which is threaded into the fitting groove may be provided at the other. The fitting groove has a width larger than the fitting piece in the direction parallel with the line segment linking the pair of rails.

In accordance with such a configuration, the fitting piece which fits the fitting groove may move in the direction parallel with the line segment linking the pair of rails in the inside of the fitting groove which has a width larger than the fitting piece. Thus, the female screw block and the member are connected through the sliding member to be movable relative to each other in the direction parallel with the line segment linking the pair of rails.

In the member assembling apparatus of a rotary machine according to the present invention, the sliding member may connect the female screw block and the member to be movable relative to each other in a direction perpendicular to a line segment linking the pair of rails in the plane perpendicular to the female screw axis.

In accordance with such a configuration, when the deviation of the movement distance along the rails is caused between the support portions, there is a case in which the member moves in the direction perpendicular to the line segment linking the pair of rails. However, even in this case, the movement of the member is absorbed by the sliding member. Therefore, a load is not applied to the screw shaft and a bending is not caused at the screw shaft. Thus, the screw shaft may be smoothly rotated.

In the member assembling apparatus of a rotary machine according to the present invention, a pin may be provided to protrude in the direction perpendicular to the line segment linking the pair of rails with one of the female screw block and the sliding member, and a pin insertion hole into which the pin is insertable may be provided at the other.

In such a configuration, the pin may move in a protruding direction of the pin, namely, in the direction perpendicular to the line segment linking the pair of rails by being ejected from or inserted into the pin insertion hole. Thus, the female screw block and the member are connected through the sliding member to be movable relative to each other in the direction perpendicular to the line segment linking the pair of rails.

In the member assembling apparatus of a rotary machine according to the present invention, the rotary machine may be a gas turbine and the member constituting the rotary machine may be a combustor transition piece.

In such a configuration, the screw shaft is smoothly rotated, and thereby the combustor transition piece may be smoothly attachable to and detachable from the gas turbine.

Advantage of the Invention

In a member assembling apparatus of a rotary machine according to the present invention, when a member advances and retracts by turning a ball screw in order to attach and detach the member constituting the rotary machine, a load may be prevented from being applied to the ball screw and the ball screw may be smoothly rotated, even if the member is in an inclined state.

MODE FOR CARRYING OUT THE INVENTION

First Embodiment

Figure 1:
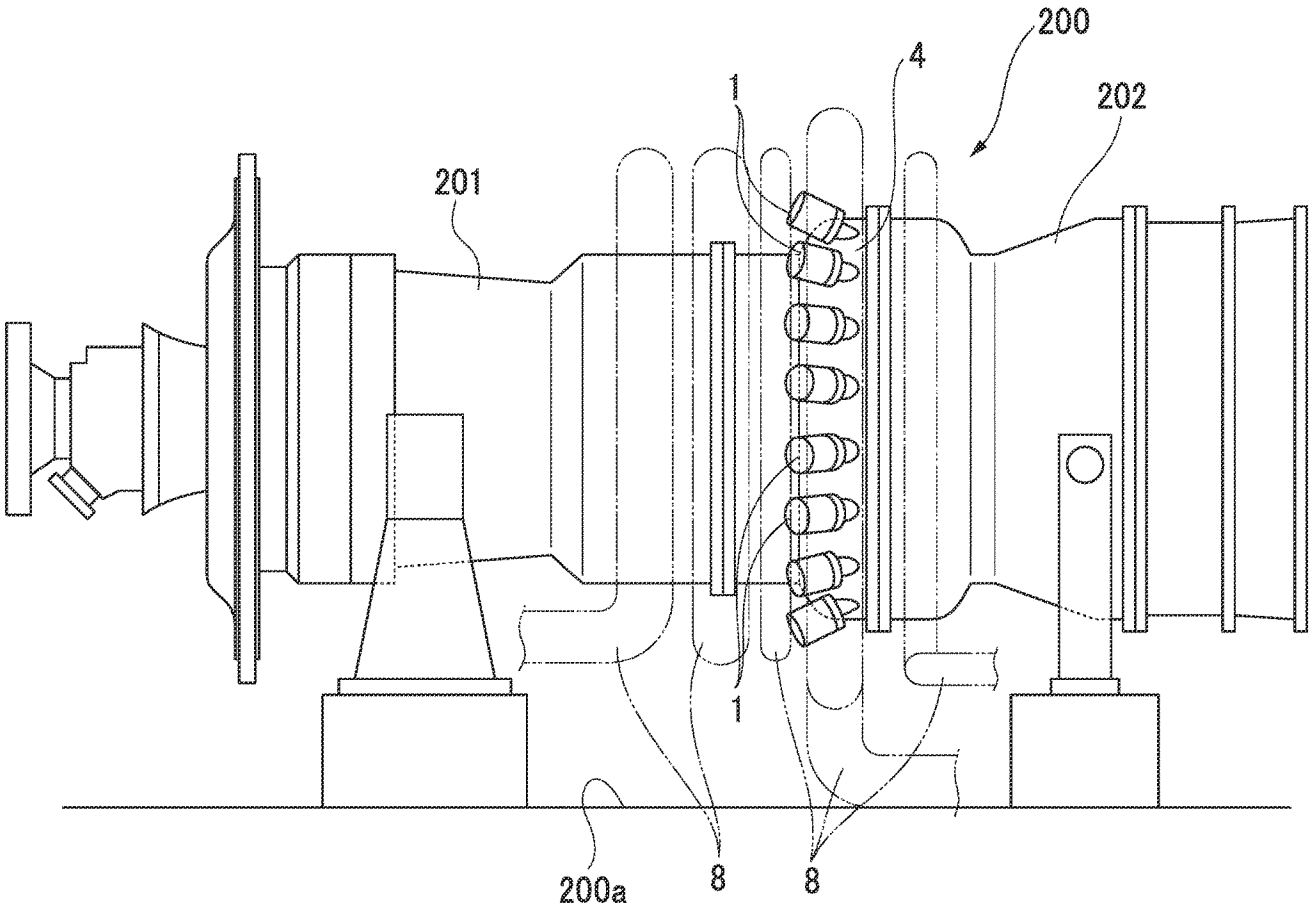
FIG. 1 is a schematic side view illustrating an outline of a gas turbine.
Figure 2:
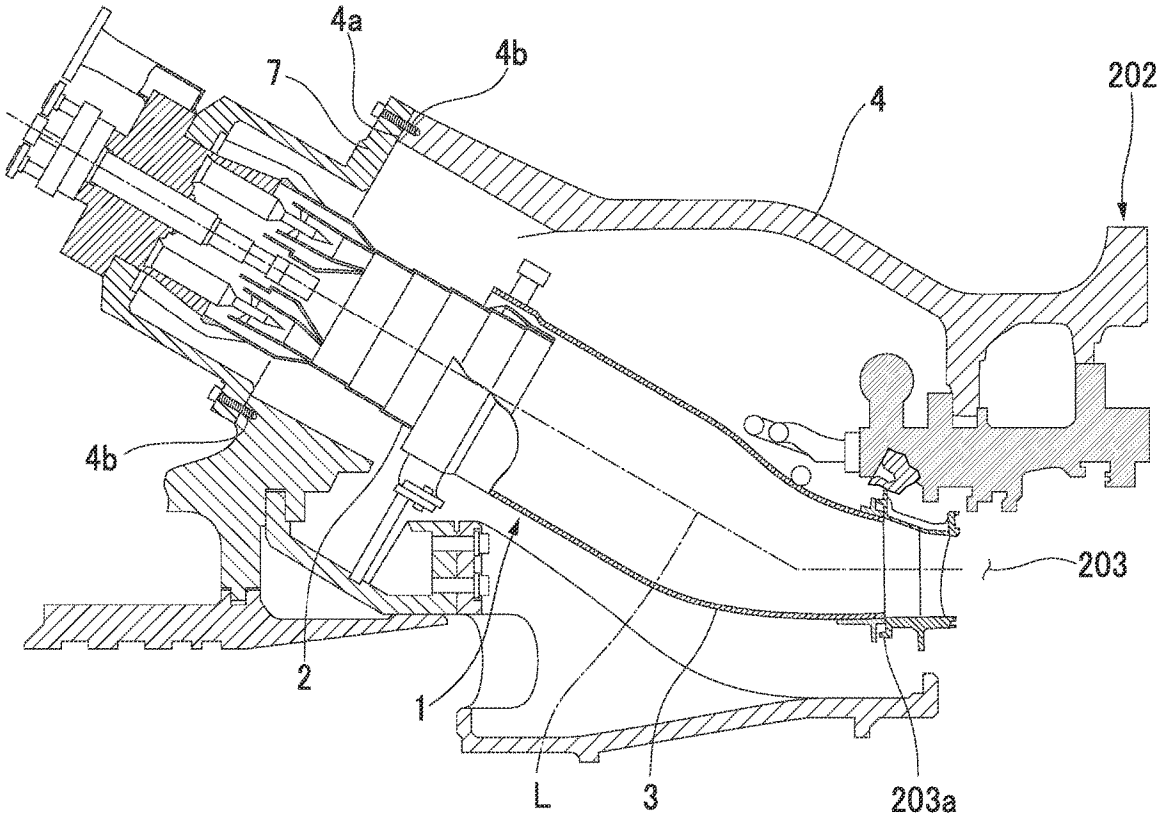
FIG. 2 is a schematic cross-sectional view illustrating a detail of a combustor and a casing of the gas turbine.
Figure 3:
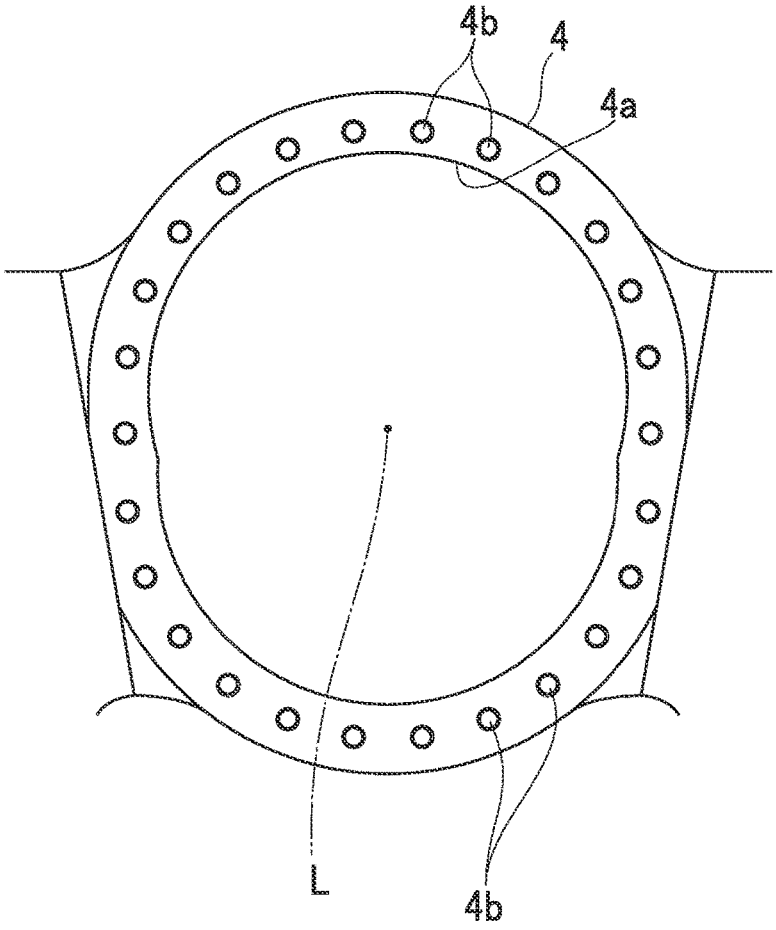
FIG. 3 is a schematic front view illustrating a detail of an opening portion of the casing of the gas turbine.

Hereinafter, embodiments of the present invention will be described with reference to the accompanying drawings. First, the following description will be given of a configuration of a member assembling apparatus of a rotary machine according to a first embodiment of the present invention. In the present embodiment, a gas turbine as an example of the rotary machine and a combustor transition piece as an example of the member constituting the rotary machine will be described. In addition, in the gas turbine 200 shown in FIG. 1, a combustor 1 and an attachment structure of the combustor 1 and a casing 4 are basically the same as those of the related art. For this reason, no description will be given of the same features and only different features will be described.

Figure 4:
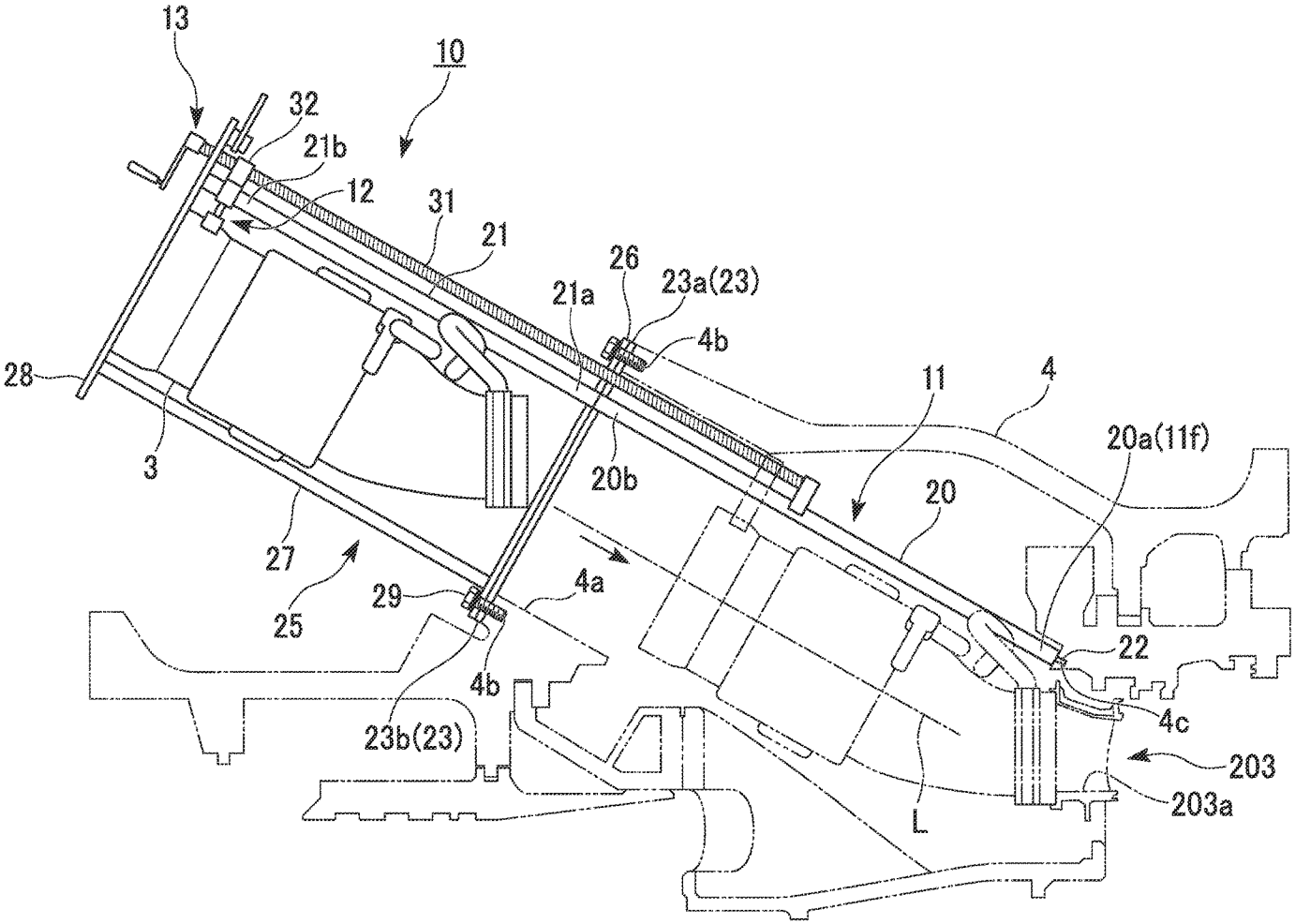
FIG. 4 is a schematic cross-sectional view illustrating a state where a transition piece assembling apparatus according to a first embodiment of the present invention is attached to a casing.

FIG. 4 is a schematic cross-sectional view illustrating a state where a transition piece assembling apparatus 10 according to a first embodiment of the present invention is attached to a casing 4. As shown in FIG. 4, the transition piece assembling apparatus 10 includes a rail 11 which is disposed along the direction of the axis L of the combustor, a support portion 12 which is attachable to and detachable from the combustor transition piece 3 and is movable along the rail 11, and an advancing and retracting mechanism 13 which is able to advance and retract the combustor transition piece 3 attached to the rail 11 through the support portion 12 along the direction of the axis L of the combustor.

Figure 6:
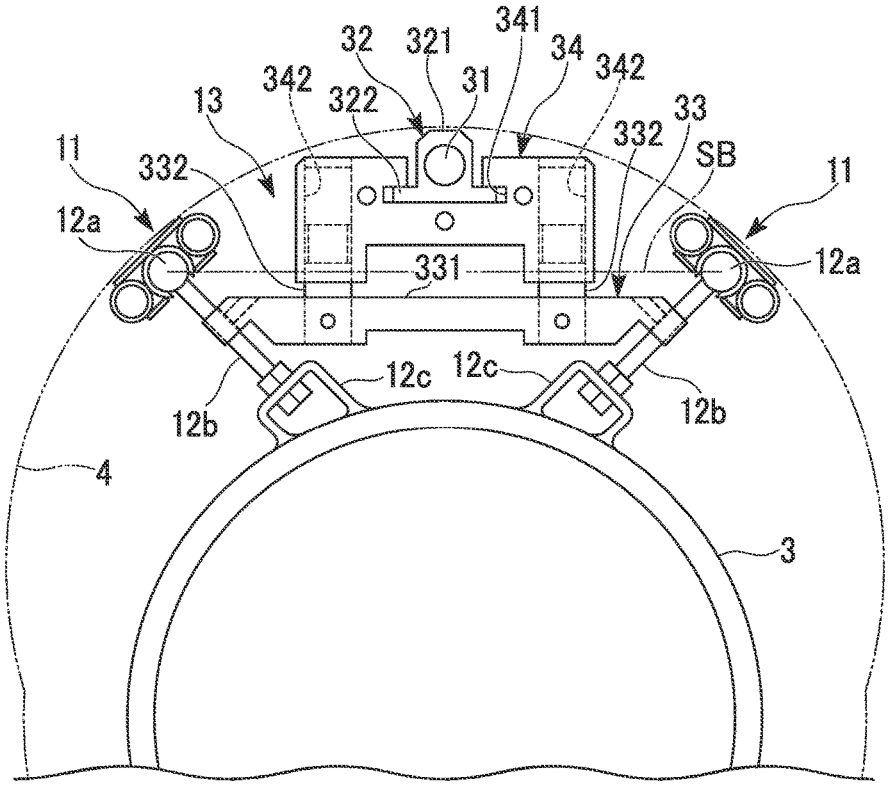
FIG. 6 is a schematic front view of the combustor transition piece illustrating a state where the transition piece assembling apparatus according to the first embodiment of the present invention is attached thereto.
Figure 7:
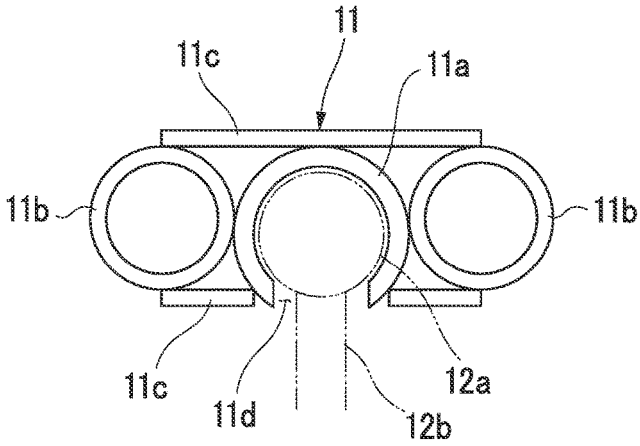
FIG. 7 is a schematic front view illustrating a rail which constitutes the transition piece assembling apparatus according to the first embodiment of the present invention.

As shown in FIGS. 4 and 6, in the embodiment, the rail 11 is provided as pairs of rails which are symmetrical to each other about the axis L of the combustor in a state of being attached to the casing 4. As shown in FIG. 7, each of the rails 11 includes a rail body 11*a* which has a substantially C-shaped cross-section, a pair of reinforcement members 11*b* which is formed in a substantially cylindrical shape and interposes both sides of the rail body 11*a* therebetween, and a connection member 11*c* which connects each of the reinforcement members 11*b* and the rail body 11*a*.

Figure 5:
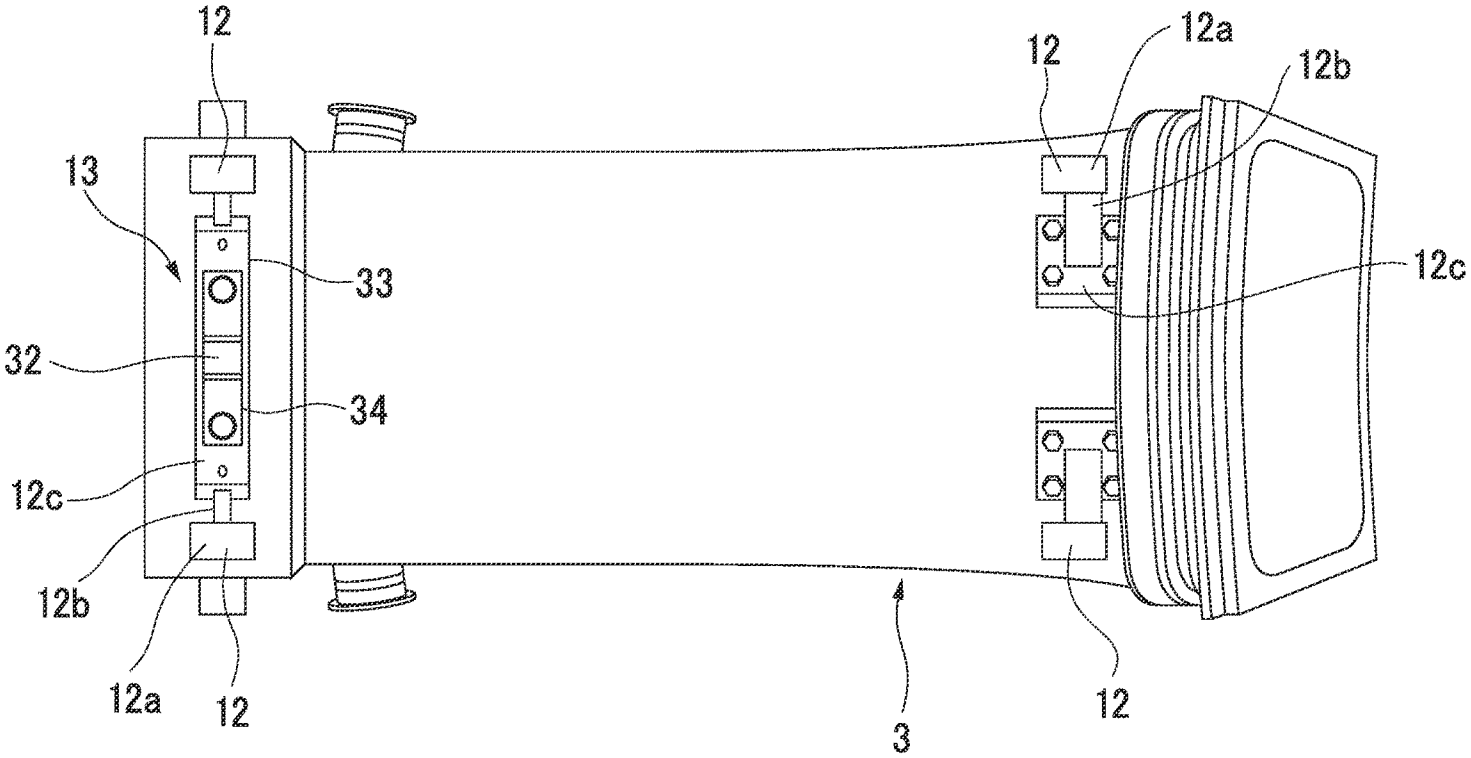
FIG. 5 is a schematic plan view of a combustor transition piece illustrating a state where the transition piece assembling apparatus according to the first embodiment of the present invention is attached thereto.

As shown in FIGS. 5 and 6, four support portions 12 are provided, and are provided at the front end side and the base end side of the combustor transition piece 3 so as to correspond to the pairs of rails 11. Each of the support portions 12 includes a piece body 12*a* which is inserted into the rail body 11*a*, an arm portion 12*b* which extends from the piece body 12*a*, and a fixing portion 12*c* which is provided at a front end of the arm portion 12*b* and is fixed to the combustor transition piece 3. The arm portion 12*b* is set to have a width smaller than a gap 11*d* of the rail body 11*a*, and is disposed at the gap 11*d* of the rail body 11*a* in a state in which the piece body 12*a* is inserted into the rail body 11*a*.

Figure 8:
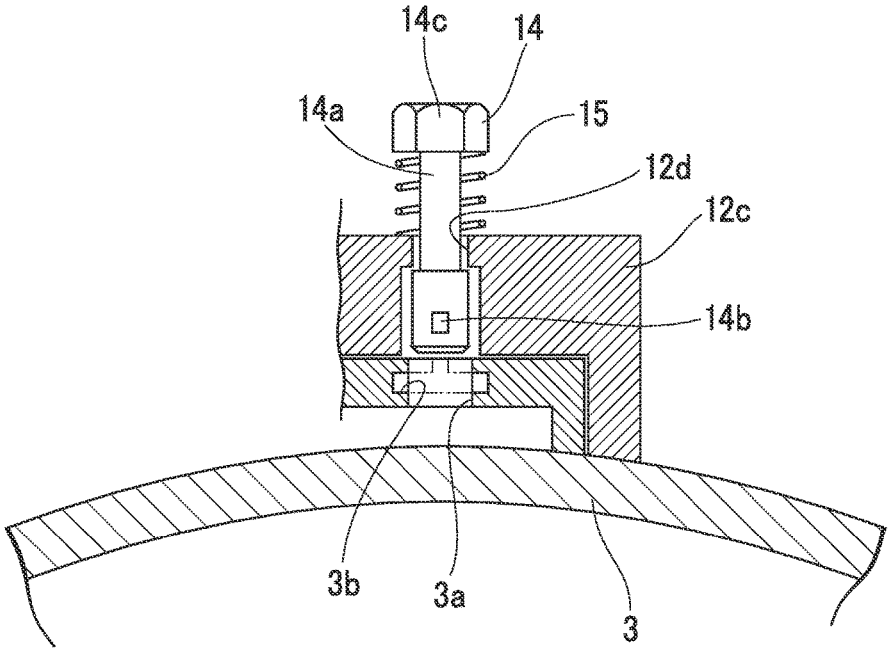
FIG. 8 is a schematic cross-sectional view illustrating a fixing structure of the rail and the combustor transition piece in the transition piece assembling apparatus according to the first embodiment of the present invention, the view illustrating a state in which the fixing of the rail and the combustor transition piece is released.
Figure 9:
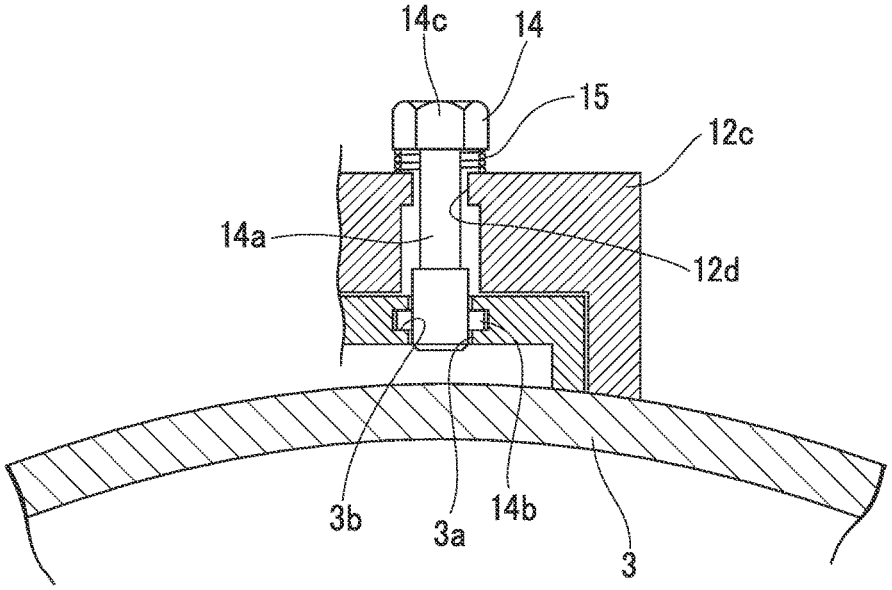
FIG. 9 is a schematic cross-sectional view illustrating a fixing structure of the rail and the combustor transition piece in the transition piece assembling apparatus according to the first embodiment of the present invention, the view illustrating a state in which the rail and the combustor transition piece are fixed.

As shown in FIGS. 8 and 9, the fixing portion 12*c* is formed with a fixture inserting hole 12*d* through which a fixture 14 is inserted. The fixture 14 includes a shaft portion 14*a* which is inserted into the fixture inserting hole 12*d*, a key 14*b* which is provided at a front end of the shaft portion 14*a* which faces the combustor transition piece 3, and a head portion 14*c* which is provided at a base end of the shaft portion 14*a* so as to increase in diameter. A spring member 15 is interposed between the head portion 14*c* and the fixing portion 12*c*. On the other hand, the combustor transition piece 3 is formed with an insertion hole 3*a* through which the front end of the shaft portion 14*a* of the fixture 14 is insertable, and a key groove 3*b* which is formed on an inner peripheral surface of the insertion hole 3*a* and into which the key 14*b* is inserted. With such a configuration, when the fixture 14 is made to advance toward the combustor transition piece 3 against the restoring force of the spring member 15 so that the front end of the shaft portion 14*a* is inserted into the insertion hole 3*a* and the fixture 14 is rotated about the axis in this state, the key 14*b* and the key groove 3*b* engage with each other, with the consequence that the support portion 12 may be fixed to the combustor transition piece 3. In addition, when the fixture 14 is rotated about the axis in the direction opposite to the fixing direction in a state in which the support portion 12 and the combustor transition piece 3 are fixed to each other so as to release the engagement between the key 14*b* and the key groove 3*b*, the support portion 12 may be detached from the combustor transition piece 3.

As shown in FIG. 4, in the embodiment, the rail 11, which movably guides the support portion 12, includes a front end member 20 which forms the front end side, and a base end member 21 which forms the base end side while being attachably and detachably connected to the front end member 20. Each of the front end member 20 and the base end member 21 has a configuration which includes the rail body 11*a*, the reinforcement member 11*b*, and the connection member 11*c*, as shown in FIG. 7. As shown in FIG. 4, a front end 20*a* of the front end member 20 is provided with a support pin 22 which protrudes therefrom. On the other hand, an inner surface of the casing 4 is formed with a concave portion 4*c* to which the support pin 22 is able to be fitted, and the support pin 22 provided in the front end member 20 is fitted to the concave portion 4*c*, and thereby a front end 11*f* of the rail 11 is supported by the casing 4.

Figure 10:
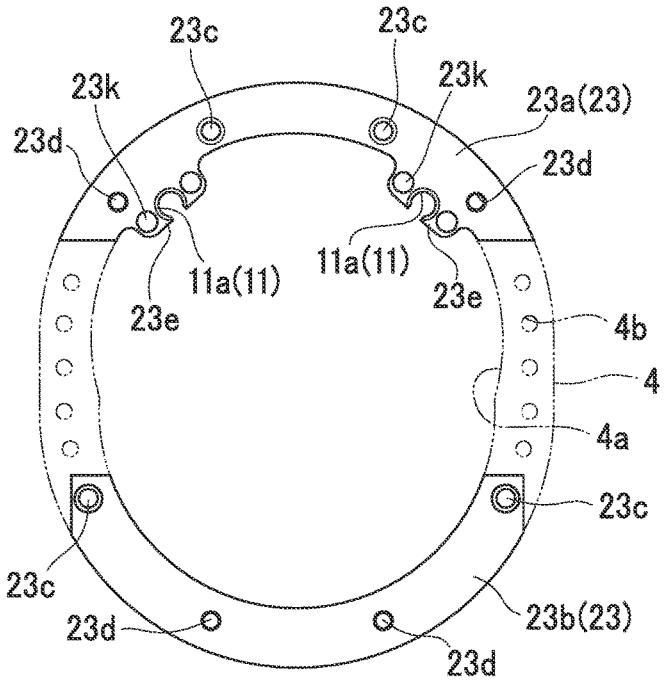
FIG. 10 is a schematic cross-sectional view illustrating the detail of a front end member of the rail and a first casing attachment plate in the transition piece assembling apparatus according to the first embodiment of the present invention.
Figure 11:
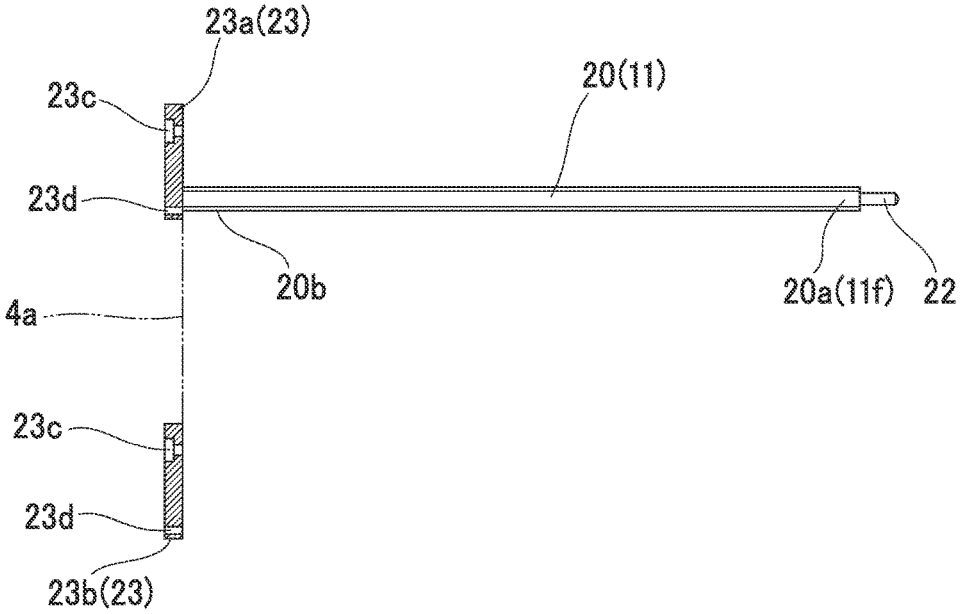
FIG. 11 is a schematic cross-sectional view illustrating the detail of the front end member of the rail and the first casing attachment plate in the transition piece assembling apparatus according to the first embodiment of the present invention.

The front end member 20 is set to have a length corresponding to the depth of the casing 4, and a first casing attachment plate 23 is attachably and detachably mounted to a base end 20*b* located near an opening portion 4*a*. As shown in FIGS. 10 and 11, the first casing attachment plate 23 is formed in a substantially annular shape along an outer edge of the opening portion 4*a* of the casing 4. In the embodiment, the first casing attachment plate 23 includes an upper member 23*a* to which the rail 11 is connected and which has a substantially arc shape, and a lower member 23*b* which has a substantially arc shape and is attached to the casing 4 at the side facing the upper member 23*a* with the axis L of the combustor being interposed therebetween.

Each of the upper member 23*a* and the lower member 23*b* constituting the first casing attachment plate 23 is provided with first through holes 23*c* and second through holes 23*d* which correspond to cover fixing bolt holes 4*b* serving as a cover fixing portion of a cover body 7 blocking the opening portion 4*a*. The first through holes 23*c* are to fix each of the upper member 23*a* and the lower member 23*b* of the first casing attachment plate 23. Each of the first through holes 23*c* has a hole into which a shaft portion of a fixing bolt threaded into each of the cover fixing bolt holes 4*b* is inserted, and an accommodation concave portion which increases in diameter from the hole at the side opposite to the surface coming into contact with the casing 4 of the upper member 23*a* and accommodates a head portion of the fixing bolt 24. In addition, the second through holes 23*d* are to fix a base end fixing portion 25 to be described below. Each of second through holes 23*d* is formed with only a hole into which a shaft portion of a fixing bolt 29 (see FIG. 4) threaded into the cover fixing bolt hole 4*b* is inserted. Furthermore, each of the upper member 23*a* and the lower member 23*b* is formed with two first through holes 23*c* and two second through holes 23*d*, such that four through holes are provided in total for each member. In the upper member 23*a*, the first through holes 23*c* are disposed near the center, and the second through holes 23*d* are disposed outside the first through holes 23*c*. In contrast, in the lower member 23*b*, the second through holes 23*d* are disposed near the center, and the first through holes 23*c* are disposed outside the second through holes 23*d*. Accordingly, in the upper member 23*a* and the lower member 23*b*, the arrangement relationship of the first through holes 23*c* and the second through holes 23*d* is reversed.

Figure 12:
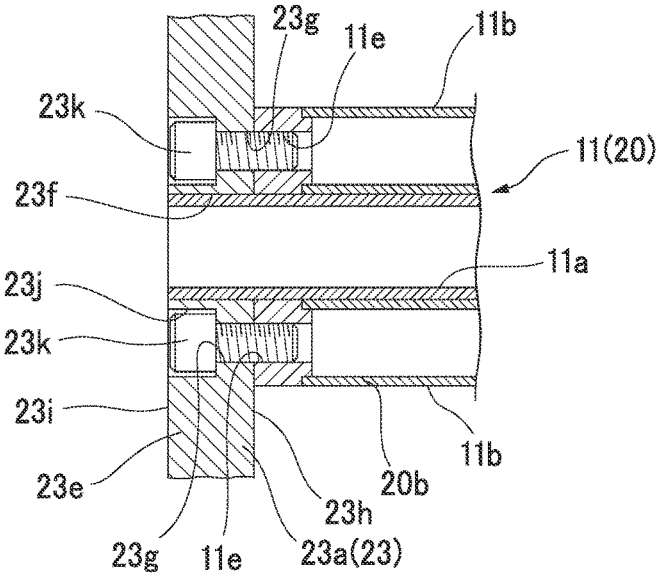
FIG. 12 is a schematic cross-sectional view illustrating the detail of a fixing structure of the front end member of the rail and the first casing attachment plate in the transition piece assembling apparatus according to the first embodiment of the present invention.

The inner edge side of the upper member 23*a* is provided with connection portions 23*e* of which each protrudes to the inner peripheral side at a position corresponding to the rail 11 and the front end member 20 is attachably and detachably connected. As shown in FIG. 12, the connection portion 23*e* is formed with a guide insertion hole 23*f* into which the rail body 11*a* of the front end member 20 is inserted, and bolt inserting holes 23*g* which are provided at both sides of the guide insertion hole 23*f*. On the other hand, in the base end 20*b* of the front end member 20 of the rail 11, the rail body 11*a* protrudes by an amount corresponding to the thickness of the first casing attachment plate 23 with respect to the reinforcement member 11*b*. For this reason, when the rail body 11*a* is inserted into the guide insertion hole 23*f* so that the reinforcement member 11*b* comes into contact with the first casing attachment plate 23, an end portion of the rail body 11*a* is positioned at substantially the same level as the other surface 23*i* opposite to one surface 23*h* with which the reinforcement member 11*b* of the first casing attachment plate 23 comes into contact. In addition, an end portion of the reinforcement member 11*b* is formed with a connection bolt hole 11*e* which corresponds to each of the bolt inserting holes 23*g*. Therefore, a connection bolt 23*k* inserted into the bolt inserting hole 23*g* from the other surface 23*i* is threaded into the connection bolt hole 11*e*, thereby connecting the upper member 23*a* of the first casing attachment plate 23 to the front end member 20 of the rail 11. The bolt inserting hole 23*g* is formed with an accommodation concave portion 23*j* which accommodates a head portion of the connection bolt 23*k*, such that the connection bolt 23*k* does not protrude from the other surface 23*i*.

Figure 13:
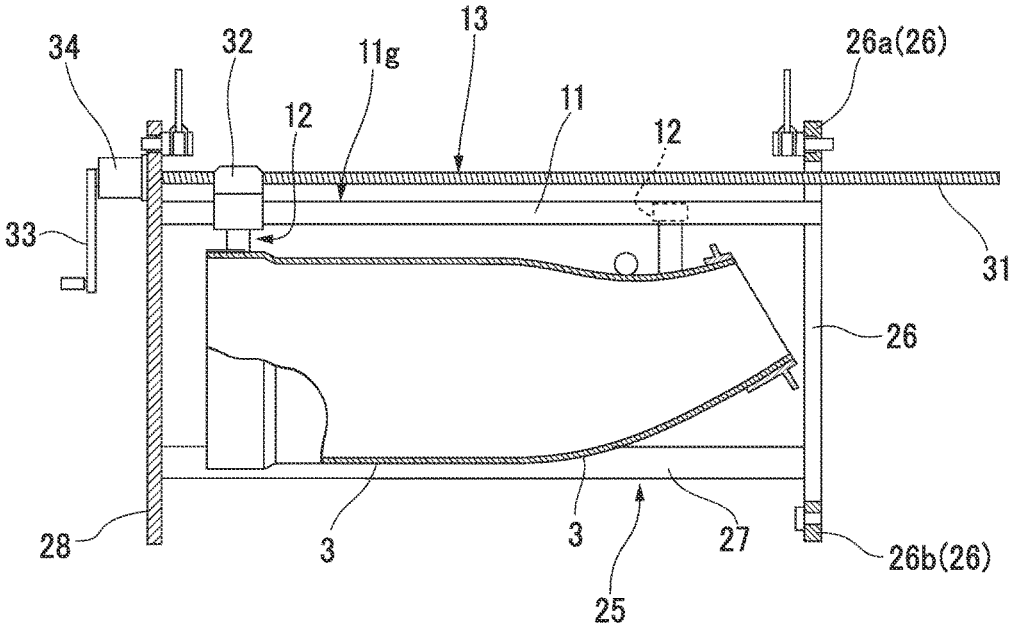
FIG. 13 is a schematic cross-sectional view illustrating the detail of a base end member of the rail, a base end fixing portion, and an advancing and retracting mechanism in the transition piece assembling apparatus according to the first embodiment of the present invention.
Figure 14:
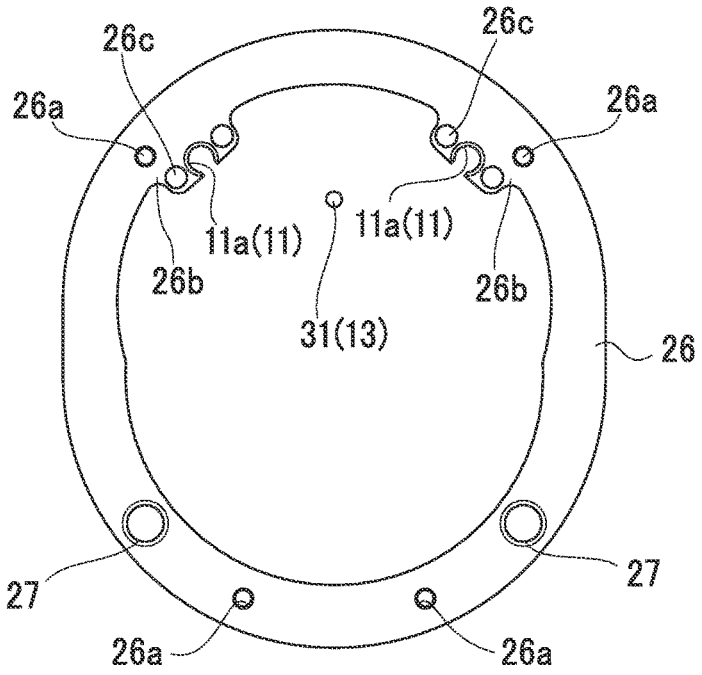
FIG. 14 is a schematic back view illustrating the detail of the base end member of the rail, the base end fixing portion, and the advancing and retracting mechanism in the transition piece assembling apparatus according to the first embodiment of the present invention.
Figure 15:
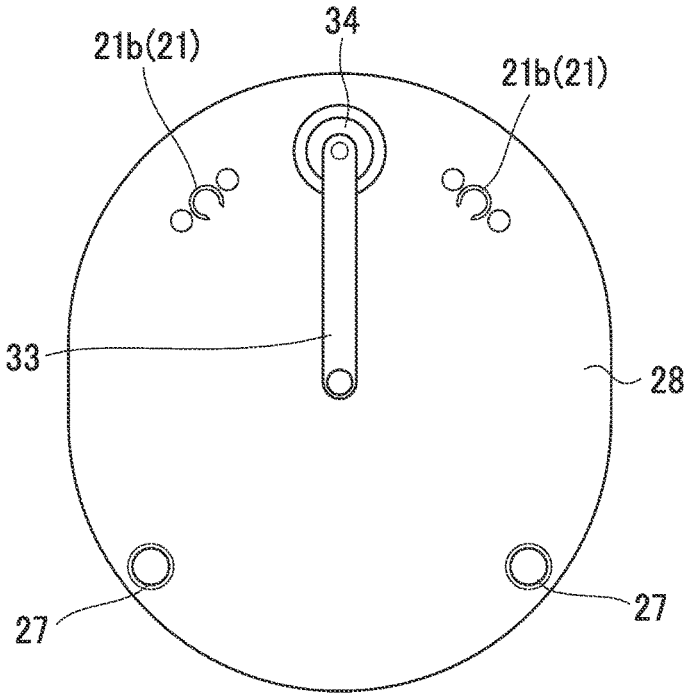
FIG. 15 is a schematic front view illustrating the detail of the base end member of the rail, the base end fixing portion, and the advancing and retracting mechanism in the transition piece assembling apparatus according to the first embodiment of the present invention.

As shown in FIG. 4, in the rail 11, the front end 21*a* of the base end member 21 is connected to the front end member 20 by the base end fixing portion 25 fixed to the casing 4 while the base end 21*b* thereof is supported by the casing 4. Specifically, as shown in FIGS. 13 to 15, the base end fixing portion 25 includes a second casing attachment plate 26 which is attached to the casing 4 through the first casing attachment plate 23, support members 27 which protrude from the second casing attachment plate 26 toward a base end 11*g* of the rail 11, and a fixing plate 28 which is provided at base ends of the support members 27 and to which the base end 21*b* of the base end member 21 of the rail 11 is connected. The second casing attachment plate 26 is formed in a substantially annular shape along the outer edge of the opening portion 4*a* of the casing 4 so as to correspond to the first casing attachment plate 23. As shown in FIG. 14, the second casing attachment plate 26 is formed with four third through holes 26*a* which communicate with the total of four second through holes 23*d* formed in the upper member 23*a* and the lower member 23*b* of the first casing attachment plate 23. When the fixing bolt 29 (see FIG. 4) is inserted through each of the third through holes 26*a* and each of the second through holes 23*d* and is threaded into each of the cover fixing bolt holes 4*b*, the second casing attachment plate 26 may be fixed to the casing 4 in a state in which the first casing attachment plate 23 is interposed therebetween.

Similarly to the first casing attachment plate 23, the inner peripheral edge side of the second casing attachment plate 26 is provided with connection portions 26*b* of which each protrudes to the inner peripheral side at a position corresponding to the rail 11 and the base end member 21 is attachably and detachably connected. Each of the connection portions 26*b* has the same structure as the connection portion 23*e* of the first casing attachment plate 23. In the front end 21*a* of the base end member 21, the rail body 11*a* protrudes by an amount corresponding to the thickness of the second casing attachment plate 26 with respect to the reinforcement member 11*b* and is fixed with connection bolts 26*c*. Accordingly, the base end member 21 and the front end member 20 of the rail 11 are connected to each other through the first casing attachment plate 23 and the second casing attachment plate 26, and the rail bodies 11*a* of the base end member 21 and the front end member 20 communicate with each other by the end portions of the rail bodies 11*a* being mated with each other.

The support members 27 are provided as a pair of support members interposing the axis L of the combustor in a state of being attached to the casing 4 in the embodiment. Furthermore, the fixing plate 28 fixed to the base ends of the support members 27 is a substantially disk-shaped member, and the support members 27 and the base end 21*b* of the base end member 21 of the rail 11 are fixed to the fixing plate 28, as shown in FIG. 15. That is, in the rail 11, the front end 20*a* of the front end member 20 serving as the front end 11*f* as a whole is fixed to the inner surface of the casing 4 by the support pin 22. In addition, in the rail 11, the base end 21*b* of the base end member 21 serving as the base end 11*g* as a whole is fixed to the casing 4 through the second casing attachment plate 26, the support members 27, and the fixing plate 28 constituting the base end fixing portion 25 so as to be supported by the casing 4. Furthermore, in the embodiment, the base end 20*b* of the front end member 20 and the front end 21*a* of the base end member 21, that is, at the substantially center position of the rail 11, are fixed to the casing 4 through the first casing attachment plate 23 and the second casing attachment plate 26 so as to be supported by the casing 4.

Figure 16:
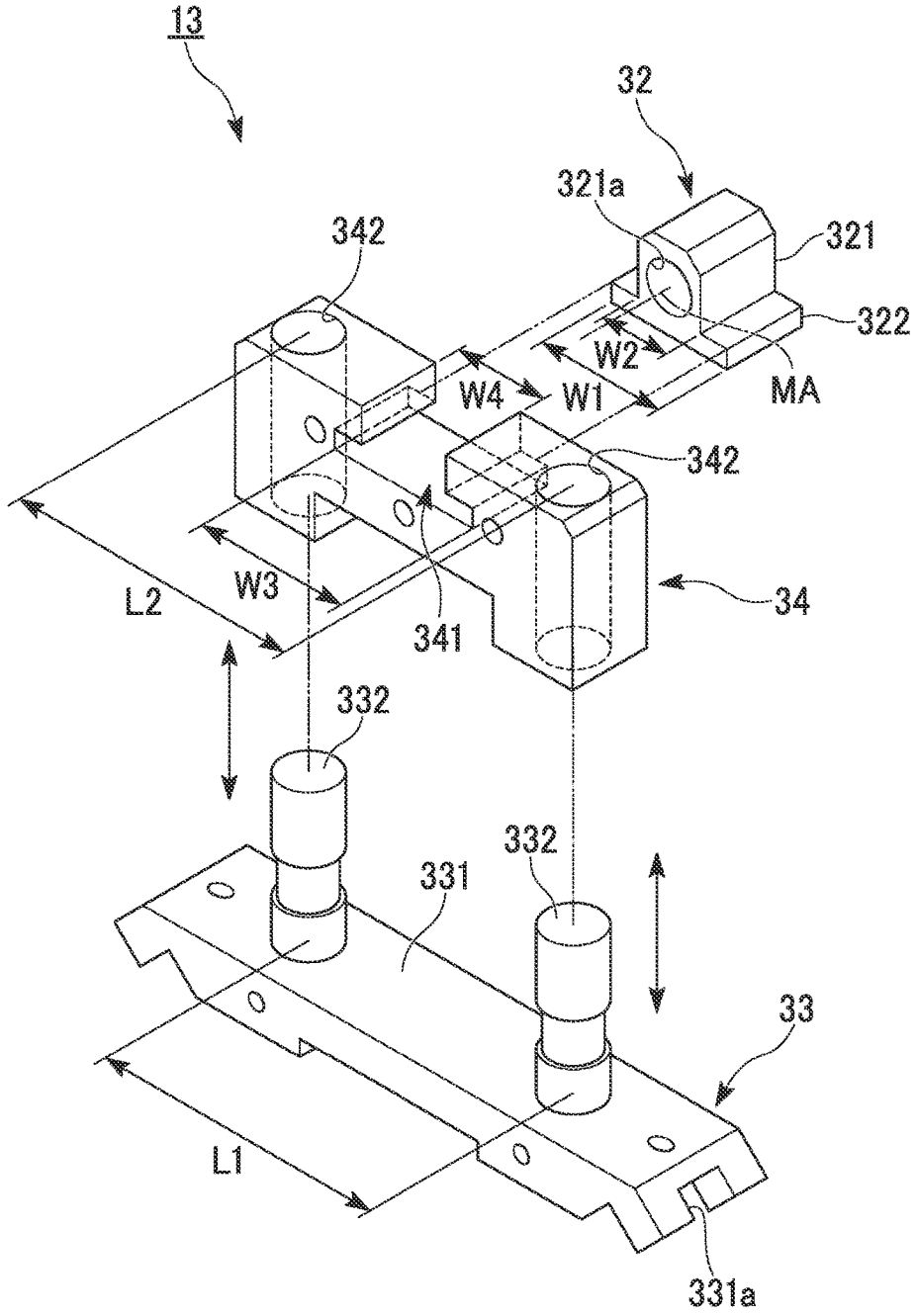
FIG. 16 is an exploded perspective view illustrating a configuration of the advancing and retracting mechanism in the transition piece assembling apparatus according to the first embodiment of the present invention.

As shown in FIG. 6, the advancing and retracting mechanism 13 includes a trapezoidal screw (screw shaft) 31 which is disposed along the rail 11, a female screw block 32 which is threaded onto the trapezoidal screw 31, a transition piece fixing member 33 which is fixed to the combustor transition piece 3, a sliding member 34 which is interposed between the female screw block 32 and the transition piece fixing member 33. FIG. 16 is an exploded perspective view illustrating a configuration of the advancing and retracting mechanism 13. Also, the trapezoidal screw 31 is not shown in FIG. 16. In addition, the trapezoidal screw 31 in the disclosure means a screw member of which screw thread has a trapezoidal cross-section.

Here, in the embodiment, although the trapezoidal screw 31 is used as a screw shaft according to the present invention, a ball screw may also be used instead. However, using the trapezoidal screw 31 as the screw shaft in the embodiment has the advantage in that foreign matter such as debris is less likely to interfere with the operation thereof and a bending thereof is less likely to occur by the action of the load than the ball screw.

As shown in FIG. 4, the trapezoidal screw 31 is disposed to extend in parallel with the axis of the casing 4 and an end portion of the trapezoidal screw 31 in the longitudinal direction thereof is rotatably supported by the fixing plate 28. A portion of the trapezoidal screw 31 in the longitudinal direction thereof is located within the casing 4 and the other portion protrudes outside the casing 4. In addition, as shown in FIG. 6, the trapezoidal screw 31 is located at a central portion of the pair of rails 11 in the horizontal direction and is located at a position near an opening edge portion of the casing 4 in the vertical direction.

As shown in FIG. 16, the female screw block 32 includes a body portion 321 which has a substantially semicircular cross-section, and a fitting piece 322 which has a flat shape. A screw hole 321*a* is formed so as to pass through the body portion 321. Although not shown in detail in the drawing, female screws are cut on an inner peripheral surface of the screw hole 321*a*. In addition, the fitting piece 322 has a lateral width W1, that is, a width in a direction perpendicular to the axial direction of the screw hole 321*a* which is larger than a lateral width W2 of the body portion 321. In the female screw block 32 having such a configuration, the trapezoidal screw 31 is threaded into the screw hole 321*a*.

As shown in FIG. 16, the transition piece fixing member 33 includes a body portion 331 which has a substantially rectangular shape when viewed from the top, and a pair of pins 332 which is provided to protrude from an upper surface of the body portion 331. Both end portions of the body portion 331 in the longitudinal direction thereof are formed with notch portions 331*a* which have a substantially rectangular shape when viewed from the top. The arm portions 12*b* of the rails 11 are fitted into the notch portions 331*a*. In addition, the pair of pins 332 of which each has a substantially circular cross-section are provided at an interval L1.

As shown in FIG. 4, in the transition piece fixing member 33 having such a configuration, the arm portions 12*b* of the pair of rails 11 are fitted and fixed into the pair of notch portions 331*a* formed at the body portion 331, respectively. Thus, the transition piece fixing member 33 is in a state of being installed between the arm portions 12*b* of the pair of rails 11.

As shown in FIG. 16, the sliding member 34 is a member which has a substantially H-shaped cross-section. An upper surface of the sliding member 34 is formed with a fitting groove 341. The fitting groove 341 has a groove width W3 larger than the lateral width W1 of the fitting piece 322 of the female screw block 32.

The fitting groove 341 has an opening width W4 larger than the lateral width W2 of the body portion 321 of the female screw block 32.

The sliding member 34 is formed with a pair of pin insertion holes 342. Each of the pin insertion holes 342 has a substantially circular cross-section. The pin insertion hole 342 has an inner diameter which is substantially equal to or slightly larger than an outer diameter of the pin 332. In addition, the pin insertion hole 342 has a height which is substantially equal to that of the pin 332. An interval L2 between the pair of pin insertion holes 342 is substantially equal to the interval L1 between the pins 332.

As shown in FIG. 16, in the sliding member 34 having such a configuration, the female screw block 32 is mounted on an upper portion of the sliding member 34 by fitting the fitting piece 322 into the fitting groove 341. At this time, as described above, the groove width W3 of the fitting groove 341 is formed to be larger than the lateral width W1 of the fitting piece 322, and the opening width W4 of the fitting groove 341 is formed to be larger than the lateral width W2 of the body portion 321. Accordingly, the fitting piece 322 may move in a direction parallel with the line segment SB indicated in FIG. 6 in the inside of the fitting groove 341. Furthermore, although not shown in detail in the drawing, both end surfaces of the sliding member 34 are covered by plate members or the like and the plate members or the like seal both end openings of the fitting groove 341. Accordingly, the fitting piece 322 is restricted from moving in a longitudinal direction, that is, in a direction substantially perpendicular to the lateral width direction in the inside of the fitting groove 341.

In addition, as shown in FIG. 16, the sliding member 34 is mounted to the transition piece fixing member 33 by inserting the pair of pins 332 into the pair of pin insertion holes 342. At this time, the sliding member 34 may move in a direction perpendicular to the line segment SB indicated in FIG. 6 by the pins 332 being ejected from or inserted into the pin insertion holes 342. In this way, the sliding member 34 connects the female screw block 32 and the transition piece fixing member 33 to be movable relative to each other in a plane perpendicular to a female screw axis MA.

Effects

Figure 17A:
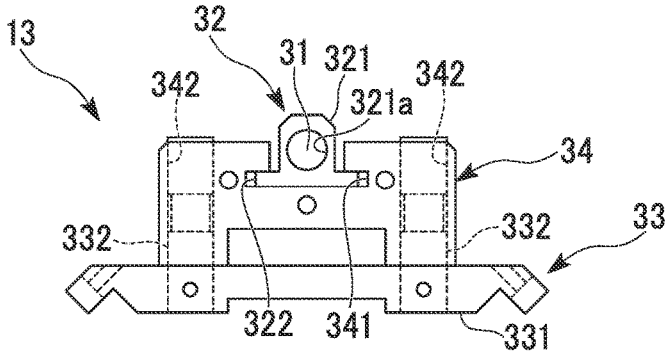
FIG. 17A is a view for explaining an effect of the transition piece assembling apparatus according to the first embodiment of the present invention.
Figure 17B:
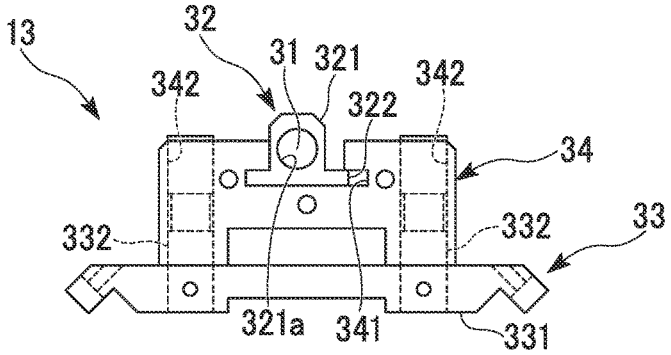
FIG. 17B is a view for explaining an effect of the transition piece assembling apparatus according to the first embodiment of the present invention.

Next, an effect of the transition piece assembling apparatus 10 according to the first embodiment of the present invention will be described. FIGS. 17A and 17B are views for explaining an effect of the transition piece assembling apparatus 10 according to the first embodiment. First, when the support portions 12, which are provided at the combustor transition piece 3, move along the rails 11 by an equal distance, the axis of the combustor transition piece 3 is in agreement with the axis of the combustor 1. In this case, as shown in FIG. 17A, the fitting piece 322 of the female screw block 32 is located at the central portion in the groove width direction in the inside of the fitting groove 341 of the sliding member 34. In addition, in this case, the pair of pins 332 of the transition piece fixing member 33 are in a state of being inserted into the pin insertion holes 342 of the sliding member 34 up to the base thereof.

Figure 17C:
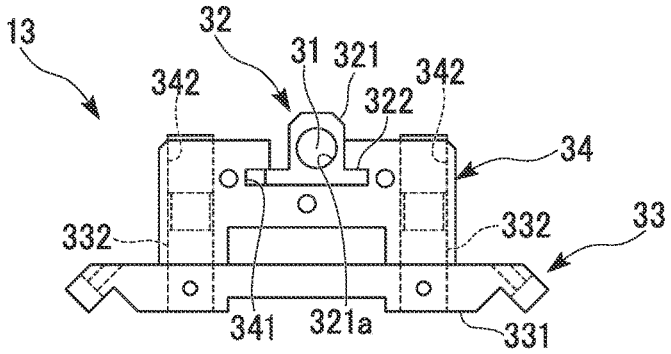
FIG. 17C is a view for explaining an effect of the transition piece assembling apparatus according to the first embodiment of the present invention.

When a deviation of a movement distance along the rails 11 is caused between the support portions 12 provided at the combustor transition piece 3, there is a case in which the combustor transition piece 3 moves in a direction parallel with the line segment SB linking the pair of rails 11 as shown in FIG. 6. However, in this case, the sliding member 34 moves from a state indicated in FIG. 17A to the right toward the paper and enters a state indicated in FIG. 17B, thereby absorbing the movement of the combustor transition piece 3. Alternatively, the sliding member moves from a state indicated in FIG. 17A to the left toward the paper and enters a state indicated in FIG. 17C, thereby absorbing the movement of the combustor transition piece 3. Accordingly, a load is not applied to the trapezoidal screw 31 even by the movement of the combustor transition piece 3 and a bending is not caused at the trapezoidal screw 31. Thus, the trapezoidal screw 31 may be smoothly rotated and the combustor transition piece 3 may be smoothly moved.

Figure 17D:
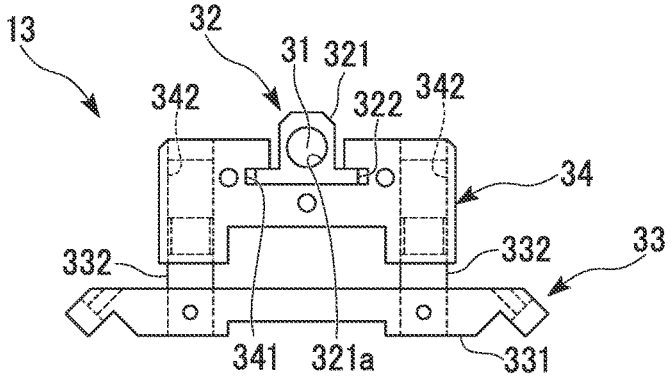
FIG. 17D is a view for explaining an effect of the transition piece assembling apparatus according to the first embodiment of the present invention.

When the deviation of the movement distance along the rails 11 is caused between the support portions 12 provided at the combustor transition piece 3, there is a case in which the combustor transition piece 3 moves in a direction perpendicular to the line segment SB linking the pair of rails 11 as shown in FIG. 6. However, in this case, the transition piece fixing member 33 moves from a state indicated in FIG. 17A to the lower side toward the paper and enters a state indicated in FIG. 17D, thereby absorbing the movement of the combustor transition piece 3. Accordingly, a load is not applied to the trapezoidal screw 31 even by the movement of the combustor transition piece 3 and a bending is not caused at the trapezoidal screw 31. Thus, the trapezoidal screw 31 may be smoothly rotated and the combustor transition piece 3 may be smoothly moved.

Second Embodiment

Next, a member assembling apparatus of a rotary machine according to a second embodiment of the present invention will be described. Similarly to the first embodiment, also in the present embodiment, a gas turbine as an example of the rotary machine and a combustor transition piece as an example of a member constituting the rotary machine will be described. In a transition piece assembling apparatus 10 according to the present embodiment, only a configuration of an advancing and retracting mechanism 40 differs from that of the transition piece assembling apparatus 10 according to the first embodiment. Since the other configurations are identical to those of the first embodiment, the same reference numerals will be given to the same components and no description will be given thereof.

FIGS. 18A to 18D are views illustrating the advancing and retracting mechanism 40 according to the second embodiment. The advancing and retracting mechanism 40 includes a trapezoidal screw (screw shaft) 41, a female screw block 42 which is threaded onto the trapezoidal screw 41, a transition piece fixing member 43 which is fixed to the combustor transition piece 3, and a sliding member 44 which is interposed between the female screw block 42 and the transition piece fixing member 43.

As shown in FIGS. 18A to 18D, the female screw block 42 includes a body portion 421 which has a substantially semicircular cross-section, a flat plate portion 422 which has a flat shape, and a pin 423 which protrudes from a bottom surface of the flat plate 422. A screw hole 421*a* is formed so as to pass through the body portion 421. In addition, although not shown in detail in the drawing, female screws are cut on an inner peripheral surface of the screw hole 421*a*.

Figure 18A:
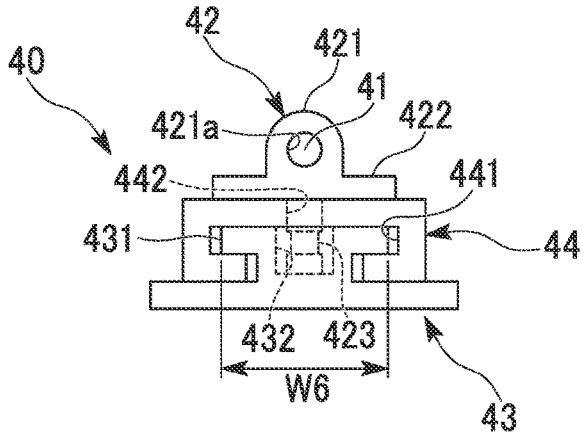
FIG. 18A is a view illustrating an advancing and retracting mechanism in a transition piece assembling apparatus according to a second embodiment of the present invention.
Figure 18B:
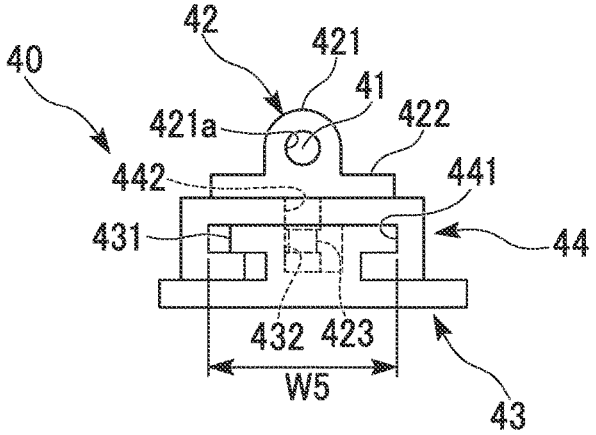
FIG. 18B is a view illustrating the advancing and retracting mechanism in the transition piece assembling apparatus according to the second embodiment of the present invention.
Figure 18C:
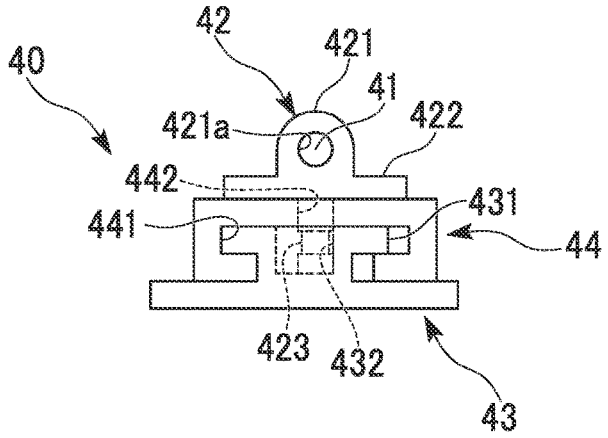
FIG. 18C is a view illustrating the advancing and retracting mechanism in the transition piece assembling apparatus according to the second embodiment of the present invention.
Figure 18D:
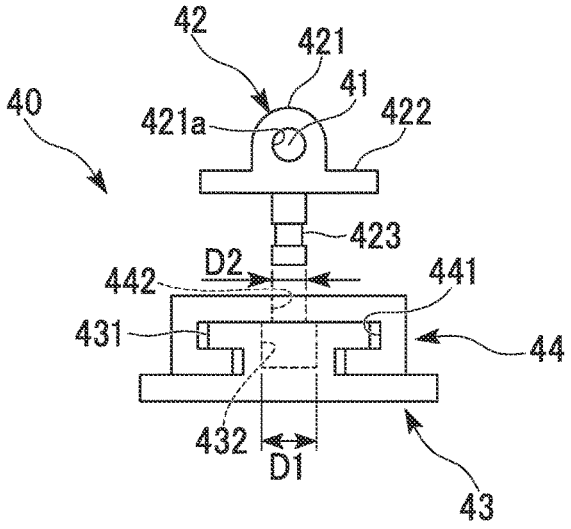
FIG. 18D is a view illustrating the advancing and retracting mechanism in the transition piece assembling apparatus according to the second embodiment of the present invention.

As shown in FIGS. 18A to 18D, the transition piece fixing member 43 includes a fitting piece 431 which has a substantially flat shape. In addition, an upper surface of the transition piece fixing member 43 is formed with a pin insertion hole 432 into which the pin 423 is inserted. As shown in FIG. 18D, the pin insertion hole 432 has a hole diameter D1 larger than an outer diameter D2 of the pin 423.

As shown in FIGS. 18A to 18D, the sliding member 44 is a member which has a substantially C-shaped cross-section. A lower surface of the sliding member 44 is formed with a fitting groove 441. The fitting groove 441 has a groove width W5 larger than a lateral width W6 of the fitting piece 431 of the transition piece fixing member 43. In addition, the sliding member 44 is penetratively formed with a pin inserting hole 442 which has substantially the same diameter as the pin 423.

As shown in FIG. 18A, in the sliding member 44 having such a configuration, the transition piece fixing member 43 is mounted on a lower portion of the sliding member 44 by fitting the fitting piece 431 into the fitting groove 441. At this time, as described above, the groove width W5 of the fitting groove 441 is formed to be larger than the lateral width W6 of the fitting piece 431. Accordingly, the fitting piece 431 may move in a direction parallel with the line segment SB indicated in FIG. 6 in the inside of the fitting groove 441. Furthermore, although not shown in detail in the drawing, both end surfaces of the sliding member 44 are covered by plate members or the like and the plate members or the like seal both end openings of the fitting groove 441. Accordingly, the fitting piece 431 is restricted from moving in a longitudinal direction, namely, in a direction substantially perpendicular to the lateral width direction in the inside of the fitting groove 441.

In addition, as shown in FIG. 18A, the female screw block 42 is mounted to an upper portion of the sliding member 44 by inserting the pin 423 into the pin inserting hole 442. Then, the pin 423 is inserted into the pin insertion hole 432 of the transition piece fixing member 43. At this time, the sliding member 44 may move in a direction perpendicular to the line segment SB indicated in FIG. 6 by the pin 423 being ejected from or inserted into the pin insertion hole 432. In this way, the sliding member 44 connects the female screw block 42 and the transition piece fixing member 43 to be movable relative to each other in a plane perpendicular to a female screw axis MA.

Next, an effect of the transition piece assembling apparatus 10 according to the second embodiment of the present invention will be described. First, when the support portions 12, which are provided at the combustor transition piece 3, move along the rails 11 by an equal distance, the axis of the combustor transition piece 3 is in agreement with the axis of the combustor 1. In this case, as shown in FIG. 18A, the fitting piece 431 of the transition piece fixing member 43 is located at the central portion in the groove width direction in the inside of the fitting groove 441 of the sliding member 44. In addition, in this case, the pin 423 of the female screw block 42 passes through the pin inserting hole 442 of the sliding member 44 and is inserted into the pin insertion holes 432 of the transition piece fixing member 43.

When a deviation of a movement distance along the rails 11 is caused between the support portions 12 provided at the combustor transition piece 3, there is a case in which the combustor transition piece 3 moves in a direction parallel with the line segment SB linking the pair of rails 11 as shown in FIG. 6. However, in this case, the transition piece fixing member 43 moves from a state indicated in FIG. 18A to the right toward the paper and enters a state indicated in FIG. 18B, thereby absorbing the movement of the combustor transition piece 3. Alternatively, the transition piece fixing member 43 moves from a state indicated in FIG. 18A to the left toward the paper and enters a state indicated in FIG. 18C, thereby absorbing the movement of the combustor transition piece 3. Accordingly, a load is not applied to the trapezoidal screw 41 even by the movement of the combustor transition piece 3 and a bending is not caused at the trapezoidal screw 41. Thus, the trapezoidal screw 41 may be smoothly rotated and the combustor transition piece 3 may be smoothly moved.

When the deviation of the movement distance along the rails 11 is caused between the support portions 12 provided at the combustor transition piece 3, there is a case in which the combustor transition piece 3 moves in a direction perpendicular to the line segment SB linking the pair of rails 11 as shown in FIG. 6. However, in this case, the transition piece fixing member 43 and the sliding member 44 move from a state indicated in FIG. 18A to the lower toward the paper and enter a state indicated in FIG. 18D, thereby absorbing the movement of the combustor transition piece 3. Accordingly, a load is not applied to the trapezoidal screw 41 even by the movement of the combustor transition piece 3 and a bending is not caused at the trapezoidal screw 41. Thus, the trapezoidal screw 41 may be smoothly rotated and the combustor transition piece 3 may be smoothly moved.

Third Embodiment

Next, a member assembling apparatus of a rotary machine according to a third embodiment of the present invention will be described. Similarly to the first embodiment, also in the present embodiment, a gas turbine as an example of the rotary machine and a combustor transition piece as an example of a member constituting the rotary machine will be described. In a transition piece assembling apparatus 10 according to the present embodiment, only a configuration of an advancing and retracting mechanism 50 differs from that of the transition piece assembling apparatus 10 according to the first embodiment. Since the other configurations are identical to those of the first embodiment, the same reference numerals will be given to the same components and no description will be given thereof.

Figure 19:
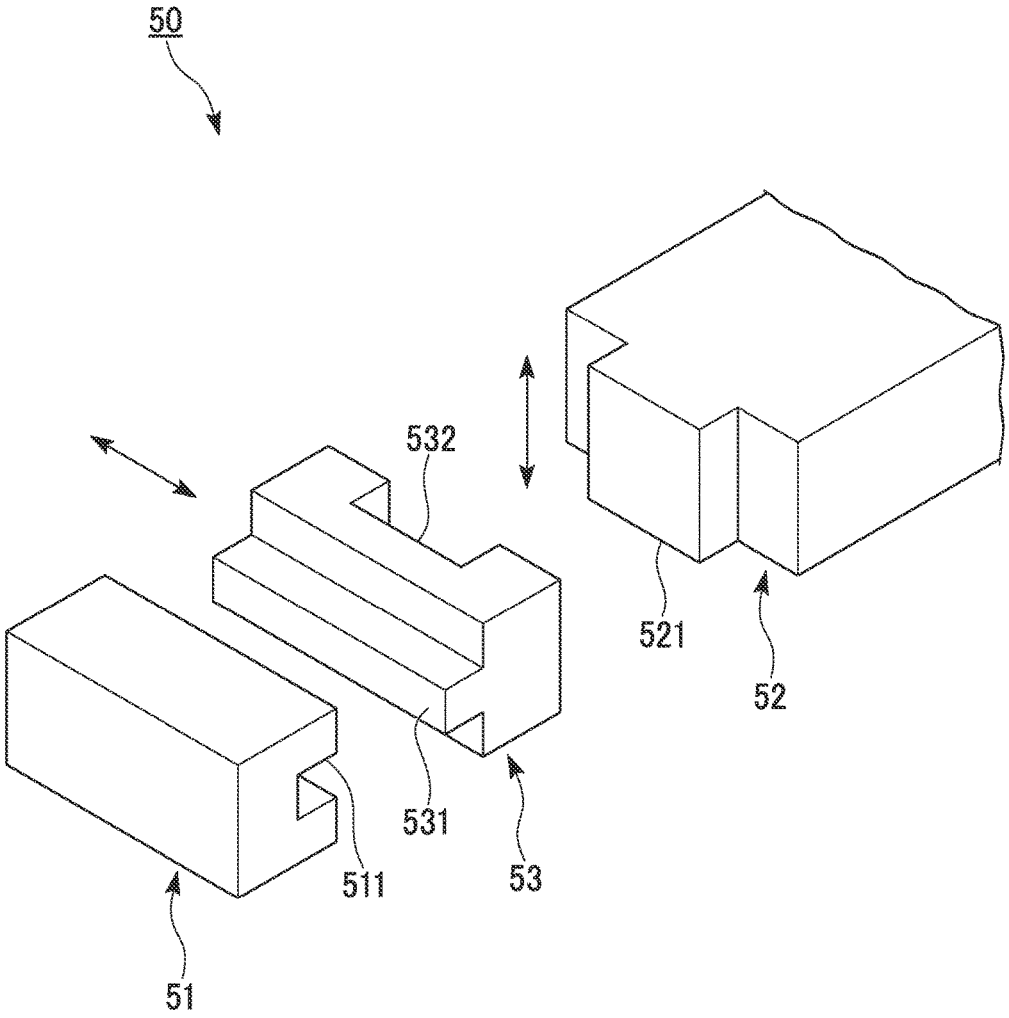
FIG. 19 is an exploded perspective view illustrating an advancing and retracting mechanism in a transition piece assembling apparatus according to a third embodiment of the present invention.

FIG. 19 is an exploded perspective view illustrating a configuration of the advancing and retracting mechanism 50 according to the third embodiment. The advancing and retracting mechanism 50 includes a trapezoidal screw (screw shaft) which is not shown, a female screw block 51 which is threaded onto the trapezoidal screw, a transition piece fixing member 52 which is fixed to the combustor transition piece 3, and a sliding member 53 which is interposed between the female screw block 51 and the transition piece fixing member 52.

As shown in FIG. 19, the female screw block 51 is formed with a groove portion 511. In addition, the transition piece fixing member 52 is formed with a protrusion 521. The sliding member 53 is formed with a convex portion 531 which is fitted into the groove portion 511, and a concave portion 532 into which the protrusion 521 is fitted and which extends in a direction perpendicular to the convex portion 531.

In such a configuration, the sliding member 53 slides with respect to the female screw block 51 or the transition piece fixing member 52 slides with respect to the sliding member 53, thereby enabling the absorption of the movement of the combustor transition piece 3 in a direction parallel with or perpendicular to the line segment SB indicated in FIG. 6.

Furthermore, various shapes, combinations, operation procedures or the like of each component illustrated in the above-mentioned embodiments serve as an example, and various modifications and variations can be made based on the design requirement and the like without departing from the spirit or scope of the present invention.

INDUSTRIAL APPLICABILITY

A member assembling apparatus of a rotary machine according to the present invention includes a pair of rails which is provided to be in the direction parallel with an axis of a member constituting a rotary machine, and to be spaced at intervals in a plane perpendicular to the axis of a member constituting a rotary machine, support portions which are connected to the member constituting the rotary machine and support the member to be movable in longitudinal directions of the rails, a screw shaft which is disposed in parallel with the axis of the member constituting the rotary machine between the pair of rails, a female screw block which is threaded onto the screw shaft, and a sliding member which is provided between the female screw block and the member and connects the female screw block and the member to be movable relative to each other in a plane perpendicular to a female screw axis.

In the member assembling apparatus of a rotary machine according to the present invention, when a member advances and retracts by turning a ball screw in order to attach and detach the member constituting the rotary machine, a load may be prevented from being applied to the ball screw and the ball screw may be smoothly rotated, even if the member is an inclined state.

DESCRIPTION OF REFERENCE NUMERALS AND SIGNS

1: combustor
2: combustor inner cylinder
3: combustor transition piece
3*a*: insertion hole
3*b*: key groove

4: casing
4*a*: opening portion
4*b*: cover fixing bolt hole
4*c*: concave portion
7: cover body
8: pipe
10: transition piece assembling apparatus
11: rail
11*a*: rail body
11*b*: reinforcement member
11*c*: connection member
11*d*: gap
11*e*: connection bolt hole
11*f*: front end
11*g*: base end
12: support portion
12*a*: piece body
12*b*: arm portion
12*c*: fixing portion
12*d*: fixture inserting hole
13: advancing and retracting mechanism
14: fixture
14*a*: shaft portion
14*b*: key
14*c*: head portion
15: spring member
20: front end member
20*a*: front end
20*b*: base end
21: base end member
21*a*: front end
21*b*: base end
22: support pin
23: first casing attachment plate
23*a*: upper member
23*b*: lower member
23*c*: first through hole
23*d*: second through hole
23*e*: connection portion
23*f*: guide insertion hole
23*g*: bolt inserting hole
23*h*: one surface
23*i*: other surface
23*j*: accommodation concave portion
23*k*: connection bolt
24: fixing bolt
25: base end fixing portion
26: second casing attachment plate
26*a*: third through hole
26*b*: connection portion
26*c*: connection bolt
27: support member
28: fixing plate
29: fixing bolt
31: trapezoidal screw
32: female screw block
33: transition piece fixing member
34: sliding member
200: gas turbine
200*a*: installation surface
201: compressor
202: turbine
203: combustion gas passage
203*a*: inlet portion
321: body portion
321*a*: screw hole
322: fitting piece
331: body portion
331*a*: notch portion
332: pin
341: fitting groove
342: pin insertion hole
40: advancing and retracting mechanism
41: trapezoidal screw
42: female screw block
421: body portion
421*a*: screw hole
422: flat plate portion
423: pin
43: transition piece fixing member
431: fitting piece
432: pin insertion hole
44: sliding member
441: fitting groove
442: pin inserting hole
50: advancing and retracting mechanism
51: female screw block
511: groove portion
52: transition piece fixing member
521: protrusion
53: sliding member
531: convex portion
532: concave portion
D1: hole diameter
D2: outer diameter
L: axis of combustor
L1: interval
L2: interval
MA: female screw axis
SB: line segment
W1: lateral width
W2: lateral width
W3: groove width
W4: opening width
W5: groove width
W6: lateral width

The invention claimed is:

1. An apparatus for assembling a member, the apparatus comprising:

a pair of rails, the rails being parallel to each other and separated by an interval;

support portions which are connectable to the member which is capable of moving in longitudinal directions of the rails;

a screw shaft which is parallel to the rails and disposed between the rails;

a female screw block which is threaded onto the screw shaft; and a sliding member which is provided between the female screw block and the support portions and connects the female screw block and the support portions in a manner such that the female screw block is movable relative to the support portions in a plane perpendicular to a female screw axis of the female screw block, wherein the sliding member connects the female screw block and the support portions in a manner such that the female screw block is movable relative to the support portions in a direction parallel with a line segment linking the pair of rails in the plane perpendicular to the female screw axis, wherein a fitting groove is provided at one of the female screw block and the sliding member, and a fitting piece which is fitted into the fitting groove is provided at another of the female screw block and the sliding member, and wherein the fitting groove has a width larger than the fitting piece in the direction parallel with the line segment linking the pair of rails.

2. The apparatus for assembling a member according to claim 1, wherein the sliding member connects the female screw block and the support portions in a manner such that the female screw block is movable relative to the support portions in a direction perpendicular to the line segment linking the pair of rails in the plane perpendicular to the female screw axis.

3. The apparatus for assembling a member according to claim 1, the apparatus further comprising:

a fixing member fixed to the assembled member, wherein a pin is provided at one of the fixing member and the sliding member to protrude in the direction perpendicular to the line segment linking the pair of rails, and a pin insertion hole into which the pin is insertable is provided at another of the fixing member and the sliding member.

4. The apparatus for assembling a member according to claim 2, the apparatus further comprising:

a fixing member fixed to the assembled member, wherein a pin is provided at one of the fixing member and the sliding member to protrude in the direction perpendicular to the line segment linking the pair of rails, and a pin insertion hole into which the pin is insertable is provided at another of the fixing member and the sliding member.

5. The apparatus for assembling a member according to claim 1, wherein the member connectable to the support portions is a combustor transition piece constituting a gas turbine.

6. The apparatus for assembling a member according to claim 2, wherein the member connectable to the support portions is a combustor transition piece constituting a gas turbine.

7. The apparatus for assembling a member according to claim 3, wherein the member connectable to the support portions is a combustor transition piece constituting a gas turbine.

8. The apparatus for assembling a member according to claim 4, wherein the member connectable to the support portions is a combustor transition piece constituting a gas turbine.

9. An apparatus for assembling a member, the apparatus comprising:

a pair of rails, the rails being parallel to each other and separated by an interval;

support portions which are connectable to the member which is capable of moving in longitudinal directions of the rails;

a screw shaft which is parallel to the rails and disposed between the rails;

a female screw block which is threaded onto the screw shaft; and a sliding member which is provided between the female screw block and the support portions and connects the female screw block and the support portions in a manner such that the female screw block and the support portions are each independently movable in a plane perpendicular to a female screw axis of the female screw block, wherein the sliding member connects the female screw block and the support portions in a manner such that the female screw block is movable relative to the support portions in a direction parallel with a line segment linking the pair of rails in the plane perpendicular to the female screw axis, wherein a fitting groove is provided at one of the female screw block and the sliding member, and a fitting piece which is fitted into the fitting groove is provided at another of the female screw block and the sliding member, and wherein the fitting groove has a width larger than the fitting piece in the direction parallel with the line segment linking the pair of rails.

10. An apparatus for assembling a member, the apparatus comprising:

a pair of rails, the rails being parallel to each other and separated by an interval;

support portions which are connectable to the member which is capable of moving in longitudinal directions of the rails;

a screw shaft which is parallel to the rails and disposed between the rails;

a female screw block which is threaded onto the screw shaft; and a sliding member which is provided between the female screw block and the support portions and connects the female screw block and the support portions in a manner such that one of the female screw block and the support portions is movable with respect to the other of the female screw block and the support portions in a plane perpendicular to a female screw axis of the female screw block, wherein the sliding member connects the female screw block and the support portions in a manner such that the female screw block is movable relative to the support portions in a direction parallel with a line segment linking the pair of rails in the plane perpendicular to the female screw axis, wherein a fitting groove is provided at one of the female screw block and the sliding member, and a fitting piece which is fitted into the fitting groove is provided at another of the female screw block and the sliding member, and wherein the fitting groove has a width larger than the fitting piece in the direction parallel with the line segment linking the pair of rails.

11. The apparatus for assembling a member according to claim 9, wherein the sliding member connects the female screw block and the support portions in a manner such that the female screw block is movable relative to the support portions in a direction perpendicular to the line segment linking the pair of rails in the plane perpendicular to the female screw axis.

12. The apparatus for assembling a member according to claim 9, the apparatus further comprising:

a fixing member fixed to the assembled member, wherein a pin is provided at one of the fixing member and the sliding member to protrude in the direction perpendicular to the line segment linking the pair of rails, and a pin insertion hole into which the pin is insertable is provided at another of the fixing member and the sliding member.

13. The apparatus for assembling a member according to claim 11, the apparatus further comprising:

a fixing member fixed to the assembled member, wherein a pin is provided at one of the fixing member and the sliding member to protrude in the direction perpendicular to the line segment linking the pair of rails, and a pin insertion hole into which the pin is insertable is provided at another of the fixing member and the sliding member.

14. The apparatus for assembling a member according to claim 9, wherein the member connectable to the support portions is a combustor transition piece constituting a gas turbine.

15. The apparatus for assembling a member according to claim 11, wherein the member connectable to the support portions is a combustor transition piece constituting a gas turbine.

16. The apparatus for assembling a member according to claim 10, wherein the sliding member connects the female screw block and the support portions in a manner such that the female screw block is movable relative to the support portions in a direction perpendicular to the line segment linking the pair of rails in the plane perpendicular to the female screw axis.

17. The apparatus for assembling a member according to claim 16, the apparatus further comprising:

a fixing member fixed to the assembled member, wherein a pin is provided at one of the fixing member and the sliding member to protrude in the direction perpendicular to the line segment linking the pair of rails, and a pin insertion hole into which the pin is insertable is provided at another of the fixing member and the sliding member.

18. The apparatus for assembling a member according to claim 10, wherein the member connectable to the support portions is a combustor transition piece constituting a gas turbine.

19. The apparatus for assembling a member according to claim 16, wherein the member connectable to the support portions is a combustor transition piece constituting a gas turbine.

20. The apparatus for assembling a member according to claim 10, the apparatus further comprising:

a fixing member fixed to the assembled member, wherein a pin is provided at one of the fixing member and the sliding member to protrude in the direction perpendicular to the line segment linking the pair of rails, and a pin insertion hole into which the pin is insertable is provided at another of the fixing member and the sliding member.

* * * * *